US005320073A

United States Patent [19]

Silcott et al.

[11] Patent Number: 5,320,073

[45] Date of Patent: Jun. 14, 1994

[54] METHOD AND APPARATUS OF PREHEATING A SOOTBLOWER LANCE

[75] Inventors: Edward O. Silcott, Lancaster, Ohio; Robin R. Dunnette, Zumbro Falls; Robert L. Irelan, Rochester, both of Minn.

[73] Assignee: The Babcock and Wilcox Company, New Orleans, La.

[21] Appl. No.: 13,770

[22] Filed: Feb. 3, 1993

[51] Int. Cl.[5] ..... F22B 37/52

[52] U.S. Cl. ..... 122/392; 15/317; 15/318.1; 122/379; 122/390; 134/18; 134/56 R; 134/167 C; 165/95

[58] Field of Search ..... 122/379, 391, 392, 382, 122/390; 15/317, 318.1; 165/95; 134/167 C, 18, 56 R

[56] References Cited

U.S. PATENT DOCUMENTS

| | | | |
|---|---|---|---|
| 4,399,773 | 8/1983 | Schwade et al. | 15/317 X |
| 4,803,959 | 2/1989 | Sherrick et al. | 122/379 |
| 5,063,632 | 11/1991 | Clark et al. | 15/317 X |
| 5,181,482 | 1/1993 | Labbe et al. | 122/392 |

*Primary Examiner*—Edward G. Favors
*Attorney, Agent, or Firm*—Harness, Dickey & Pierce

[57] ABSTRACT

A retractable sootblower is provided with means for preheating the sootblower lance prior to introduction of blowing medium into the lance to prevent condensation of the blowing medium which would be subsequently discharged from the lance against internal boiler surfaces accelerating surface erosion. The sootblower of the present invention preheats the lance by only providing blowing medium to the lance after at least a portion of the lance has been extended into the boiler and heated by hot boiler gases to thereby prevent condensation of the blowing medium within a cooled lance.

10 Claims, 1 Drawing Sheet

METHOD AND APPARATUS OF PREHEATING A SOOTBLOWER LANCE

BACKGROUND AND SUMMARY OF THE INVENTION

This invention relates to a retracting sootblower for boiler cleaning and in particular to a method and apparatus for preheating the sootblower lance prior to supplying a blowing medium to the lance in the form of vapor, such as steam, to prevent condensation of the blowing medium in a cooled lance.

Sootblowers are used to project a stream of blowing medium such as air or steam against heated surfaces within boilers to cause slag and ash encrustations to be removed. The blowing medium impact produces both mechanical and thermal shock which causes these adhering layers of slag and ash to be removed. One general category of sootblowers is known as the retracting type. These devices have a retractable lance which is periodically extended into and retracted from the boiler such that one or more nozzles at the distal end of the lance project a jet of the blowing medium within the boiler. During extension and retraction, the lance may also be rotated or oscillated about its axis.

During the intervening time between sootblower operating cycles with the lance at rest outside of the boiler, the lance will cool to the ambient temperature of the air surrounding the boiler. During operation of a sootblower, as the lance is extended into the boiler, the flow of the blowing medium is initiated so that along a path traced by the blowing medium, encrustations from the boiler internal surfaces are removed. When the lance reaches its full extension into the boiler, its direction of travel is reversed and the lance is retracted from the boiler.

However, due to the cooling of the lance between operating cycles, when the lance is first extended into the boiler at the beginning of the next cleaning cycle and the blowing medium is supplied to the lance, the colder lance temperature results in partial condensation of the blowing medium vapor. The projection of the liquid condensate against the internal boiler surfaces increases the erosion of these surfaces. Erosion of boiler internal surfaces due to condensate is generally noted on the surfaces impacted by the blowing medium during the first one or two feet of extension of the lance into the boiler. After this initial lance travel, the lance will have been heated by the blowing medium and boiler gases such that condensate is no longer formed.

It is an object of the present invention to provide preheating of the lance prior to introduction of the blowing medium into the lance, thereby avoiding the cooling of the blowing medium by a colder lance to prevent condensation of the blowing medium.

It is a feature of the present invention that the lance is preheated by hot combustion gases within the boiler thus requiring no additional energy expenditure to heat the lance. Preheating is accomplished by delaying supply of blowing medium during lance extension into the boiler. The blowing medium is provided only after the lance has been heated to a predetermined temperature. As a result, when the blowing medium ultimately is provided, no condensation is produced.

Additional benefits and advantages of the present invention will become apparent to those skilled in the art to which this invention relates from the subsequent description of the preferred embodiments and the appended claims taken in conjunction with the accompanying drawings.

DETAILED DESCRIPTION OF THE INVENTION

Figure 1:
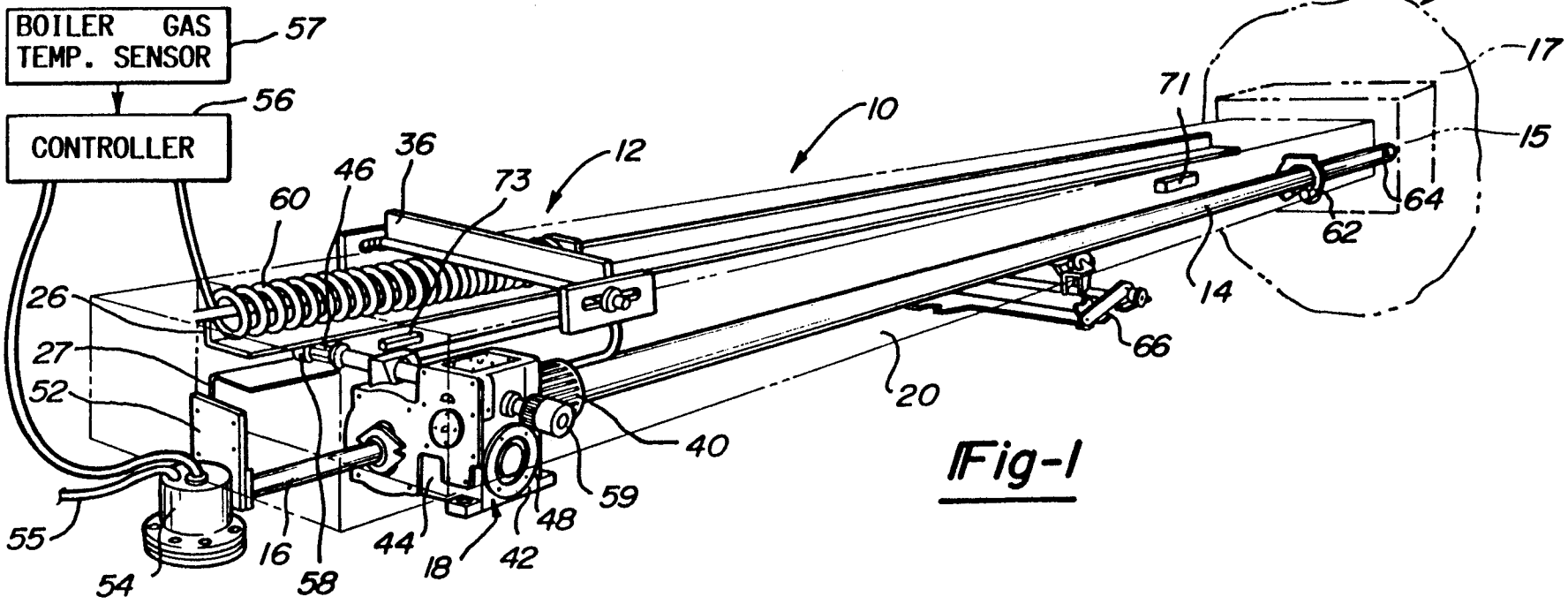
FIG. 1 is a perspective view showing a retracting sootblower of the present invention.

A sootblower of the present invention equipped for lance preheating is shown in FIG. 1 and generally designated by the reference numeral 10. Sootblower 10 principally comprises frame assembly 12, lance 14, feed tube 16, and carriage 18. Sootblower 10 is shown in its rest position. Upon actuation, lance 14 is extended into and retracted from a boiler 13. The lance 14 is also rotated about its longitudinal axis during extension and retraction.

Figure 2:
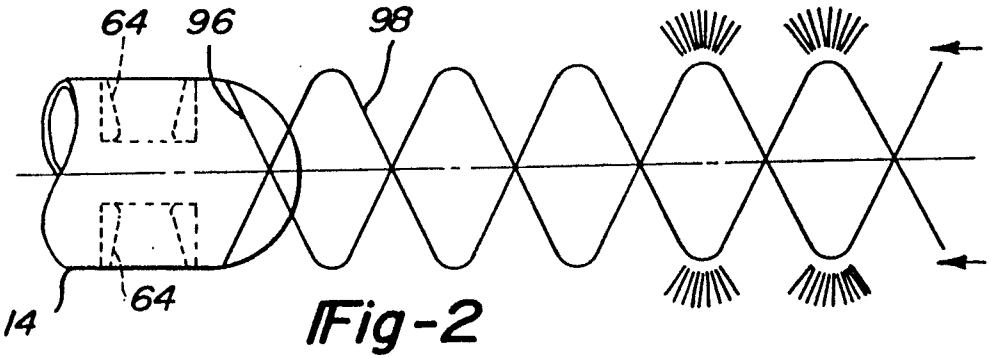
FIG. 2 is a pictorial side view showing the helical paths traced by the lance nozzles upon retraction and rotation of the lance.

Frame assembly 12 includes a generally rectangular shaped frame box 20 which forms a housing for the entire unit. Carriage 18 is guided along two pairs of tracks located on opposite sides of frame box 20, a pair of lower tracks and a pair of upper tracks, with only one upper track 26 and one lower track 27 being shown. The tracks are made from angle iron stock and are connected to frame box 20 by threaded fasteners, welding or the like. Toothed rack assemblies such as rack assembly 32 shown in FIG. 2, are rigidly connected to each of the upper tracks and are provided to enable longitudinal movement of carriage 18 as described below. Frame assembly 12 is supported at a wall box 15 which is affixed to the boiler wall 17 or another mounting structure and is further supported by rear support bracket 36.

Carriage 18 drives lance 14 in and out of the boiler and includes drive motor 40 and gear box 42 enclosed by housing 44. The gear box 42 drives a pair of pinion gears 46 and 48 which engage the rack assemblies to advance carriage 18 and lance 14. Bearings 58 and 59 engage with the aforementioned support tracks to support carriage 18. Rotation of the pinion gears 46 and 48 by the drive motor 40 through the gear box 42 induces longitudinal motion of the carriage 18 along the toothed rack assemblies. The gear box 42 also rotates the lance 14 about its longitudinal axis as the carriage is moved longitudinally.

Feed tube 16 is attached at one end to rear bracket 52 and conducts blowing medium which is controlled through the action of diaphragm actuated poppet valve 54. Poppet valve 54 is actuated by a controller 56 based upon the position of carriage 18 to begin and terminate blowing medium discharge. Lance 14 overfits feed tube 16 and a fluid seal between them is provided by a packing gland (not shown) so that the blowing medium is conducted into the lance for discharge from nozzles 64 at the distal end of lance 14. Controller 56 is preferably a programmable microprocessor.

Coiled electrical cable 60 conducts power to drive motor 40 as it moves with carriage 18. Front support bracket 62 includes bearings which support lance 14 during its longitudinal and rotational motions. For long lance lengths, an intermediate support 66 may be provided to prevent excessive bending and deflection of the lance. The above described details of construction are well known in the sootblower art. Additional details of the construction can be found in U.S. Pat. No. 3,439,376 issued to the assignee of this application and which is hereby incorporated by reference.

During extension of the lance 14 into the boiler, the poppet valve 54 remains closed so that n discharge of the blowing medium through the lance is accomplished. As a result, the lance 14 is heated by the hot combustion gases within the boiler during the extension phase of the sootblower operating cycle. Once the carriage 18 has moved the entire length of the extension, the carriage 18 contacts a limit switch 71 which signals to the controller 56 that the lance 14 is fully extended. The controller reverses the direction of motor 40 to begin the retraction phase of the cycle and also opens the poppet valve 54, supplying blowing medium to the lance 14 for discharge through nozzles 64. With reference to FIG. 2, the distal end of the lance 14 is shown equipped with a pair of oppositely directed radial nozzles 64. As the sootblower is retracted longitudinally and also rotated, the paths traced by the nozzles and the projected blowing medium form helixes 9 and 98.

The blowing medium used is a high pressurize vapor such as steam. Without preheating of the lance 14 before introduction of the blowing medium therein, the cool temperature of the lance relative to the blowing medium can cause condensation of the blowing medium within the lance. This liquid condensate is subsequently forced from the nozzle 64 and is projected against internal boiler surfaces. The impact of the condensate results in increased erosion of the boiler surfaces. By extending the lance 14 into the boiler prior to introduction of the blowing medium, the hot gases of the boiler will heat the lance such that when the blowing medium is introduced, it will not be caused to condense within the lance 14. If the boiler gas temperatures are not sufficient to heat the lance 14 to the desired temperature during extension of the lance, the controller 56 can maintain the lance 14 within the boiler for a predetermined period of time after extension to enable sufficient preheating of the lance before retraction and introduction of the blowing medium. The length of time necessary for the lance 14 to reach the desired temperature will of course depend upon the boiler gas temperature. This information can be provided to the controller 56 from a gas temperature sensor 57 in a well-known manner.

Preheating of only a distal end portion of the lance can also be used to prevent discharge of condensed blowing medium. If a distal end portion is sufficiently heated, when the blowing medium is provided, and a portion of the blowing medium condenses in the non-heated portion of the lance, the heated distal end portion will re-vaporize the condensate before discharge from the lance. Preheating of a distal end portion can be accomplished by partial insertion of the lance into the boiler followed by a dwell during which lance extension is halted until the distal end portion is sufficiently heated. Alternatively, the preheating can be accomplished during a portion of the insertion time. After preheating all or only a portion of the lance, the blowing medium is supplied.

Upon return of the carriage 18 to the fully retracted position, a limit switch 73 is activated and the controller closes the poppet valve 54 and stops the drive motor 40 as the distal end of the lance is retracted from the boiler. The poppet valve 54 can be operated either pneumatically or electronically. Preferably poppet valve 54, when closed, enables a small amount of slightly pressurized air to flow into the lance 14 for discharge through the nozzles 64 as is well known in the sootblower. This air is provided by air supply hose 55 and is used to increase the pressure within the lance 14 to a value higher than the boiler pressure to prevent heated combustion gases from flowing into the lance 14 through nozzles 64.

The sootblower of the present invention provides for preheating of the lance 14 during the extension phase of the sootblower operating cycle. This can be accomplished by: 1) only providing blowing medium to the lance 14 during the retraction phase of the sootblower operation; 2) allowing for partial extension of the lance into the boiler to heat a distal end portion of the lance; and 3) partial extension of the lance followed by a dwell time before supplying the blow medium and continuing with extension into the boiler. As a result of preheating, condensation of the blowing medium within the lance is prevented or allowed to revaporize before discharge from the lance.

While the above description constitutes the preferred embodiment of the present invention, it will be appreciated that the invention is susceptible to modification, variation and change without departing from the proper scope and meaning of the accompanying claims. For example, the lance need not be rotated completely about its longitudinal axis during travel but could be oscillated back and forth. Alternatively, the lance need not rotate at all but merely extended and retracted to clean along a straight line.

We claim:

1. A sootblower for projecting a stream of steam blowing medium against internal surfaces of a boiler, said sootblower comprising:

an elongated hollow lance having at least one nozzle at a distal end thereof through which said stream of steam blowing medium is projected against said internal surfaces;

a carriage supporting said lance at a proximal end thereof:

a frame for supporting said carriage and lance externally of said boiler;

said carriage including drive means for periodically moving said carriage along said frame to extend said lance into and retract said lance from said boiler;

means for supplying said blowing medium to said lance for projection through said at least one nozzle; and means for controlling said drive means and said means for supplying to supply said blowing medium only after at least a portion of said lance has been extended into said boiler whereby said portion of said lance is heated by hot gases within said boiler to a predetermined temperature before said blowing medium is supplied to eliminate condensed blowing medium within said lance.

2. The sootblower of claim 1 wherein said control means also controls said drive means and maintains said lance extended into said boiler for a time period sufficient for hot gases within said boiler to heat said lance to a predetermined temperature to preclude condensation of said blowing medium in said lance.

3. The sootblower of claim 1 wherein said means for controlling fully extends said lance into said boiler before supply said blowing medium to said lance.

4. The sootblower of claim 1 wherein said means for controlling partially extends said lance into said boiler before supply said blowing medium to said lance.

5. The sootblower of claim 4 wherein after said lance is partially extended into said boiler said means for controlling stops said drive means to allow said lance to dwell at partial extension until a distal end portion of said lance reaches a predetermined temperature.

6. The sootblower of claim 1 wherein said control means includes a first limit switch activated by the position of said carriage when said lance is fully extended to begin the supply of said blowing medium.

7. The sootblower of claim 6 wherein said means for controlling includes a second limit switch activated by said carriage position to stop the supply of said blowing medium as said lance distal end is retracted from said boiler.

8. The sootblower of claim 1 further comprising means for supplying pressurized air to said lance during periods when said blowing medium is not being supplied to said lance to prevent hot gases from said boiler from entering said lance through said at least one nozzle.

9. A method of cleaning internal surfaces of a boiler, comprising the steps of:

periodically longitudinally extending into said boiler an elongated hollow lance having at least one nozzle at a distal end thereof;

maintaining at least a portion of said lance within said boiler a period of time sufficient for hot gases within said boiler to heat said lance portion to a predetermined temperature; and thereafter supplying a heated and pressurized blowing medium to said lance for ejection through said at least one nozzle and impingement against said internal boiler surfaces.

10. The method of claim 9 wherein said lance is fully extended into said boiler prior to supplying said heated and pressurized blowing medium to said lance.

* * * * *